US012780373B2

(12) United States Patent
Johanneck

(10) Patent No.: US 12,780,373 B2
(45) Date of Patent: Nov. 3, 2026

(54) FLOATING WATERCRAFT PORT WITH ACTUATED BOW STOP

(71) Applicant: Rhino, Inc., Maple Lake, MN (US)

(72) Inventor: Richard G. Johanneck, Maple Lake, MN (US)

(73) Assignee: Rhino, Inc., Maple Lake, MN (US)

( * ) Notice: Subject to any disclaimer, the term of this patent is extended or adjusted under 35 U.S.C. 154(b) by 213 days.

(21) Appl. No.: 18/828,044

(22) Filed: Sep. 9, 2024

(65) Prior Publication Data

US 2025/0083782 A1 Mar. 13, 2025

Related U.S. Application Data

(60) Provisional application No. 63/537,046, filed on Sep. 7, 2023.

(51) Int. Cl.
*B63C 1/02* (2006.01)
*B63C 1/04* (2006.01)

(52) U.S. Cl.
CPC . *B63C 1/02* (2013.01); *B63C 1/04* (2013.01)

(58) Field of Classification Search
CPC .... B63C 1/02; B63C 1/04; B63C 1/06; B63C 3/02; B63P 3/1033
See application file for complete search history.

(56) References Cited

U.S. PATENT DOCUMENTS

2009/0044740 A1* 2/2009 Imel ..... B63C 3/02 114/263
2022/0063777 A1* 3/2022 Johanneck ..... B63C 1/02
2022/0063778 A1* 3/2022 Johanneck ..... B63C 1/02
2025/0369243 A1* 12/2025 Johanneck ..... E04H 1/1205

OTHER PUBLICATIONS

Wave Armor Product Assembly Instructions, #302673, Nov. 2023 (Year: 2023).*
Wave Armor Pro 170 & 220 (Year: 2025).*

* cited by examiner

*Primary Examiner* — Timothy D Collins
(74) *Attorney, Agent, or Firm* — Dicke, Billig & Czaja, PLLC

(57) ABSTRACT

One example provides a drive-on floating watercraft port including a transport track extending across an upper surface of the floating watercraft port from a stern end toward a bow end, the transport track to carry and guide a hull of a watercraft across the upper surface. An actuated bow stop disposed along a length of the transport track to define a bow end of the transport track, the bow stop selectively actuated back and forth along a portion of a length of the transport track to push a watercraft along the transport track toward the stern end when launching the watercraft from the floating watercraft port.

21 Claims, 13 Drawing Sheets

SECTION A-A

SECTION B-B

SECTION C-C

SECTION D-D

SECTION E-E

SECTION A-A

SECTION G-G

SECTION H-H

SECTION J-J

FLOATING WATERCRAFT PORT WITH ACTUATED BOW STOP

CROSS-REFERENCE TO RELATED APPLICATION

This Non-Provisional patent application claims the benefit of the filing date of U.S. Provisional Patent Application Ser. No. 63/537,046, filed Sep. 7, 2023, which is incorporated herein by reference.

BACKGROUND

Floating watercraft ports provide convenient and low-maintenance out-of-water storage of watercraft of all types, including v-shaped and multi-hull watercraft, and personal watercraft, for example. Because hull designs vary between watercraft, and because dock owners, over the course of time, may own different watercraft having different hull designs, it is advantageous for floating watercraft ports to be adjustable to accommodate different hull designs and to enable easy landing/launching operations of various watercraft.

SUMMARY

One example provides a drive-on floating watercraft port including a transport track extending across an upper surface of the floating watercraft port from a stern end toward a bow end, the transport track to carry and guide a hull of a watercraft across the upper surface. An actuated bow stop disposed along a length of the transport track to define a bow end of the transport track, the bow stop selectively actuated back and forth along a portion of a length of the transport track to push a watercraft along the transport track toward the stern end when launching the watercraft from the floating watercraft port.

One example provide a drive-on floating watercraft port including a plurality of floating sections hinged together in an articulating fashion and extending longitudinally between a stern end and a bow end, the plurality of floating sections together defining an upper surface. A transport track extends across the upper surface from the stern end toward the bow end, the transport track to carry and guide a hull of a watercraft across the upper surface. A moveable bow stop disposed at a home position along a length of the transport track, the bow stop to define a bow end of the transport track. An actuator system selectively drives the bow stop back and forth between the home position and an extended positioned to apply a force to a watercraft to move the watercraft along the transport track.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

FIGS. 11A-11J are cross-sectional views through wheel pockets and hull wheels of a floating watercraft port, according to one example.

DETAILED DESCRIPTION

Figure 1:
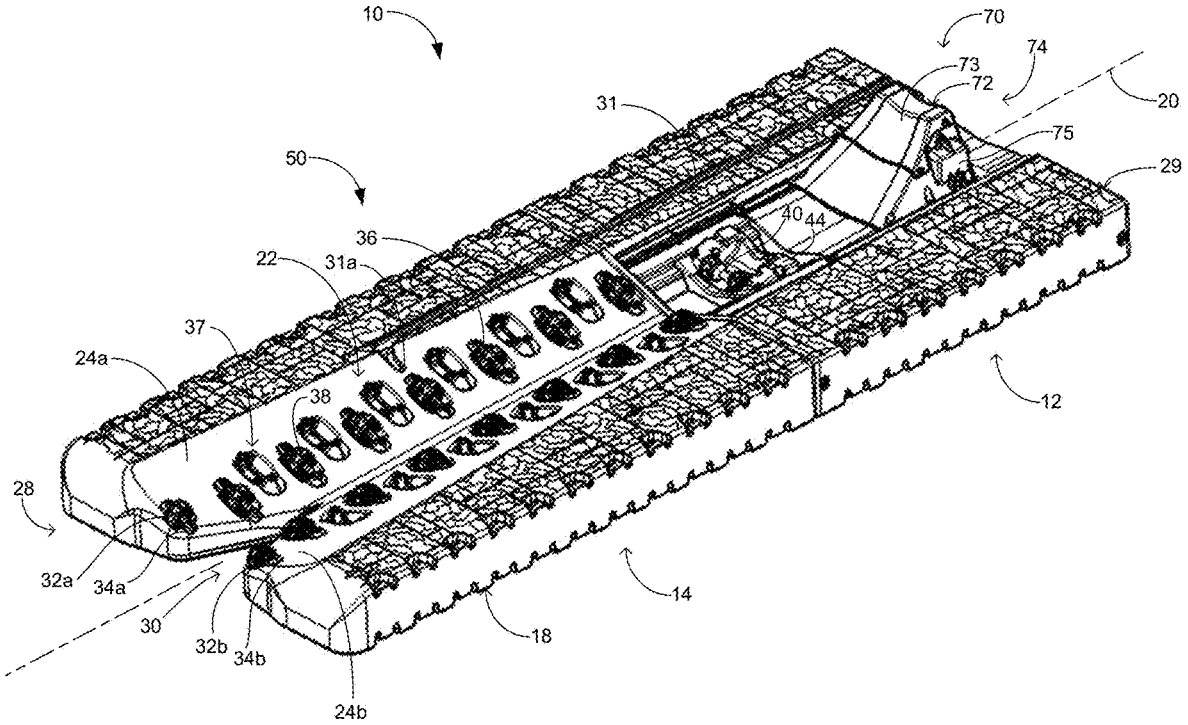
FIG. 1 is a perspective view of a floating watercraft port including an actuated bow stop, according to one example of the present disclosure.

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

When docking watercraft, it is beneficial to remove the watercraft from the water. Removing a watercraft from the water minimizes growth of barnacles and aquatic plant life on the watercraft, reduces the chances for the watercraft to acquire and transport invasive species, reduces damage from contact with a dock (e.g., "dock rash" caused by repeated rubbing of the watercraft against a dock, and denting, particularly the pontoons of pontoon boats), reduces the occurrence of oxidation and discoloration of portions of the watercraft that would otherwise be submerged, and reduces the potential for damages that might result from adverse weather and water conditions (e.g., high winds, high waves, high currents, etc.).

While traditional winch-style lifts are effective at removing watercraft from the water, such lifts have several shortcomings. First, in addition to needing to installed/removed each year, which is time consuming and costly, winch-style lifts may not suitable for use in certain conditions, such as in deep water locations where the legs of the boatlift are unable to reach the bottom of the body of water, where the bottom is too soft to support the legs of the boatlift, and in environmentally protected areas where the bottom of the body of water is prohibited from being disturbed, for example. Also, when implemented with a canopy, in high winds, traditional lifts can sometimes be moved from their foundation and even overturned, potentially resulting in extensive damage to the lift and other property. Furthermore, traditional winch-style lifts are typically manufactured using aluminum, which often becomes unsightly over time due to oxidation, and employ bunks for supporting hulls which are typically made of wood and/or other degradable materials which require ongoing maintenance and/or replacement. Additionally, winch cables and associated pulleys are prone to twisting and wearing over time which can lead to overloading and potential failure. Finally, it can be difficult and a potential safety hazard to load and unload passengers and gear (e.g., coolers, fishing gear, etc.) to/from a watercraft when disposed on/within a conventional winch-type lift.

Recently, floating watercraft ports have been developed which provide convenient drive-on docking and out-of-water storage of watercraft, and which eliminate many shortcomings of traditional winch-type lifts. Some floating watercraft ports employ a cradle-like recess formed in an upper surface of the port (e.g., generally shaped as a negative of a boat hull) and a number of wheels (and/or rollers) disposed along a length of the cradle which together form a transport track to receive and guide a hull of a watercraft across the port when landing the watercraft thereon (which may also be referred to as "loading" or "docking") or launching a watercraft therefrom. In examples, the transport track is formed by arranging the wheels in two parallel rows which are laterally spaced apart so that each row of wheels engages and supports opposing sides of the watercraft's hull during loading and launching operations.

During a loading operation, the propulsion system of the watercraft (e.g., an external propeller or water jet system) is used to propel the watercraft onto and along the transport track of the floating port to a docking (or stowed) position at which the watercraft is secured and stowed completely out of the water (via buoyancy of the floating port). Likewise, during a launching operation, for watercraft employing an outdrive propeller type propulsion system, the propeller may be positioned in the water and reverse power can be applied to pull the watercraft along the transport track and off the floating port into the water.

In some cases, some watercraft may be unable to independently propel themselves completely onto a floating port during landing operations and/or propel themselves off a floating port during launching operations. Such cases may occur when a watercraft's propulsion system is unable to generate enough thrust or is unable to engage the water when the watercraft is in the stowed position. When a watercraft is unable to independently propel itself from the floating port during a launching operation, it may be necessary for users to hand push the watercraft at least partially off the floating port. Such an approach can be problematic for a solo user or if a user(s) is unable to provide enough force to push the watercraft along the transport track. It is noted that the ability for a watercraft to independently land and/or launch itself on/from a drive-on floating port may be hindered by a transport track which does not properly align with or conform to the contours and shape of the hull of the watercraft.

In view of the above, the present disclosure provides a drive-on floating watercraft port which includes a powered launch and/or landing system to assist in pushing and/or pulling a watercraft along the transport track during launching and/or landing operation. In examples, during a launch procedure, the powered launch assist system pushes the watercraft along a transport path toward the water to assist in launching the watercraft into the water from the floating port. In examples, the power launch assist system pushes the watercraft along the transport path so that the propulsion system of the watercraft is able to engage the water and generate enough force to pull the watercraft off the lift. In other examples, the power launch assist system together with the watercraft's propulsion system generate force to launch the watercraft from the floating port. In other examples, the powered launch assist system is additionally configured to assist in pulling a watercraft along the transport track and onto the floating port during a landing (or "docking") procedure. In some examples, the power launch assist system assists in pulling a watercraft along at least a portion of the transport track to the stowed position (which may also be referred to as a landed or docked position).

In examples, as will be described in greater detail, the powered launch assist system includes a controllably driven element which is configured to engage the watercraft during a launching and/or landing process to push and/or pull the watercraft along the transport track. In some examples, as will be described in greater detail herein, the driven element comprises a powered bow stop which is drivable back and forth along a portion of a length of the transport track, and which, during a launching procedure, engages the bow of the watercraft and is driven to push the boat at least partially along a length of the transport track toward the water to assist in launching of the watercraft from the floating port. In examples, the powered bow stop pushes the watercraft along the transport track toward the water to enable the propulsion system of the watercraft to engage the water and pull a remaining portion of the boat off the transport track and into the water. In other examples, during a landing procedure, the powered bow stop may be coupled to the bow, such as via a rope/cable, to pull a watercraft along portion of a length of the transport track, such to pull a partially landed watercraft along a remaining portion of the transport track to a stowed position. In examples, a forward-most position of the bow stop (referred to herein as a "home" position of the bow stop) is adjustable over a portion of the length of the transport track. In one example, the bow stop is driven back and forth along a bow stop track using an electric motor. In one example, the electric motor (e.g., a DC stepper motor) is powered by an electric battery. In examples, the electric motor and battery are housed within the bow stop. In examples, movement of the bow stop is controlled remotely, such as via a wireless remote control or via an application on a smart phone, for example. In other examples, the driven element (e.g., the bow stop) is driven using any suitable power source, such as hydraulicly (e.g., compresses air or fluid) or stored energy in a spring, for instance.

In other examples, the present application discloses a floating port having a transport track formed, at least in part, by a plurality of wheels and/or rollers which engage and guide/transport the hull of a watercraft onto/off the floating port. In examples, positions of the wheels and/or rollers are adjustable (e.g., vertically, laterally, and angularly relative to horizontal) so that the transport track can be adapted/tailored to conform to the particular contours and shape of a hull of a watercraft being stowed on the floating port. In examples, the transport track includes a keel roller having a position which is vertically adjustable and horizontally adjustable over a portion of a length of the transport track to enable the position of the keel roller to be adjusted to a position to properly engage, lift, and direct the keel to a desired contact area of the bow stop as the watercraft if being loaded onto the floating port, with the bow stop defining the forward-most position of the watercraft's bow when in the stowed position. In examples, axles of wheels positioned along a length of the transport track may be positioned at different angles relative to horizontal so that angular positions of the wheel surfaces for engaging the hull of a watercraft can be adjusted and better tailored to the particular contours of a given watercraft hull. In other examples, a lateral spacing between the two parallel rows of wheels forming the transport track may be adjusted (e.g., closer or further apart) to accommodate narrower and wider watercraft hulls. For instance, in some examples, as will be described in greater detail below, the floating port includes two rows of recessed wheel pockets formed in the upper surface on each side of a longitudinal centerline of the floating port in which the wheels may be disposed, wherein the inner rows of wheel pockets of each side are used to form a narrower transport track (e.g., for more v-shaped hulls) and the outer rows of wheel pockets of each side are used to form a wider transport track (e.g., for flatter-bottomed hulls).

Tailoring the wheels and/or rollers to the contours and shape of a given watercraft hull enables easier transport along the transport track and thereby easier loading/launching of a watercraft onto/from the port. Additionally, adjustability of the wheels and/or rollers of the transport track, as well as adjustability of the bow stop, enables the floating watercraft port to be adjusted to accommodate varying hull designs of different watercraft an owner of the floating port may own over the life of the floating port.

Figure 2:
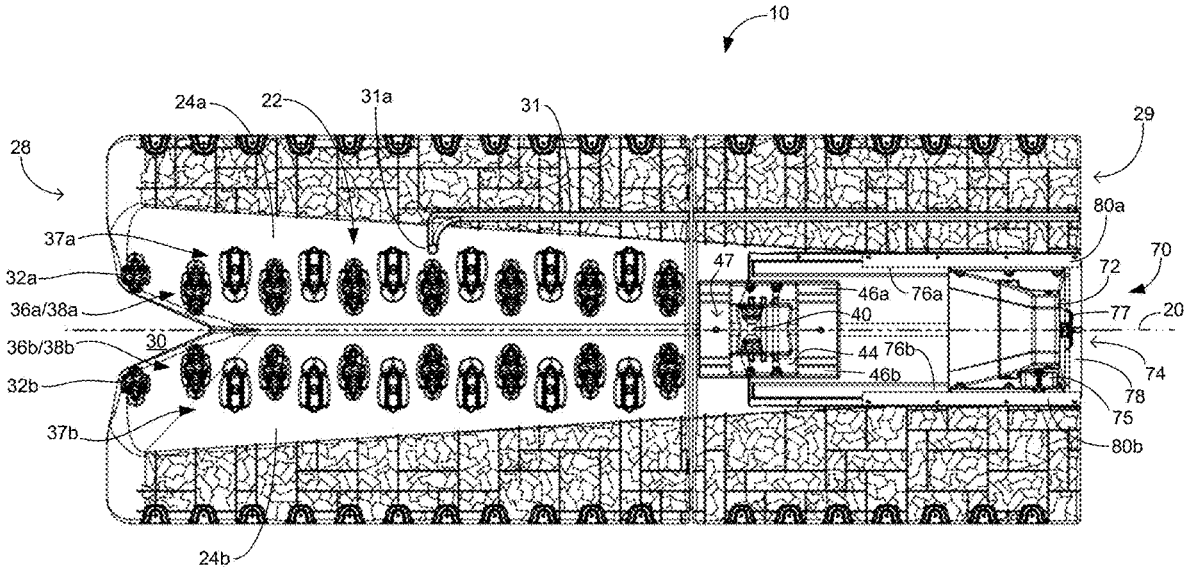
FIG. 2 is a top view of a floating watercraft port including an actuated bow stop, according to one example of the present disclosure.

FIGS. 1 and 2 respectively illustrate perspective and top views of a floating drive-on watercraft port 10 (referred to hereinafter as port 10), according to one example of the present disclosure. As illustrated, the example watercraft port 10 includes a number of floating sections, such as sections 12 and 14, which are pivotally coupled to one another to enable articulation between the sections in response to waves when port 10 installed in a body of water (where the pivotal connection enables the joint between sections, such as sections 12 and 14, to articulate both upwardly and downwardly relative to the surface of water surface). It is noted that sections 12 and 14 may be respectively referred to herein as bow section 12 and stern section 14. Together, sections 12 and 14 together form an upper surface 16 and a lower surface 18 of port 10, where lower surface 18 faces the water and upper surface 16 faces away from the water when port 10 is installed in a body of water. When installed in a body of water, upper surface 16 is disposed horizontally so as to be parallel to the water surface. In examples, bow and stern sections 12 and 14 extend longitudinally along and substantially symmetrically about a longitudinal axis or longitudinal centerline 20 of port 10.

Although illustrated as having two sections, 12 and 14, in other examples, port 10 may comprise a different number of sections (such as 1, 3, 4 . . . , etc.). In some examples, which are not illustrated, bow section 12 may be pivotally coupled to a non-floating dock (or other non-floating structure), either directly or indirectly (e.g., via another floating section). In examples, the sections of port 10, such as bow and stern sections 12 and 14, comprise rotationally molded shells of high-density polyethylene filled with a marine-grade expanded polystyrene (EPS) foam.

In one example, a hull depression 22 is molded in upper surface 16 of port 10. As illustrated, according to one example, hull depression 22 extends longitudinally along and symmetrically about longitudinal centerline 20 of port 10 and is shaped generally as the negative of a watercraft hull. In one example, as illustrated, hull depression 22 is molded in upper surface 16 of stern section 14. In one example, hull depression 22 includes port and starboard sidewalls 24*a* and 24*b* which angle upwardly from a central channel region 26 to upper surface 16 of port 10. In one example, hull depression 22 is tapered in the longitudinal direction (in a direction perpendicular to longitudinal centerline 20) so as to be wider at an entrance end 28 of stern section 14 (which also represents an entrance end 28 of port 10) than at an opposing end adjacent to bow section 12. In one example, entrance end or stern end 28 of stern section 14 includes an inlet 30 which is tapered in the direction of stern section 12 and which is configured to receive and direct a bow of an entering watercraft to align the hull with longitudinal centerline 20. It is noted that stern end 28 is opposite bow end 29 of port 10. A distance along longitudinal centerline 20 between stern end 28 and bow end 29 defines a longitudinal length of port 10.

In some examples, as illustrated, port 10 includes a number of recessed grooves or channels formed in upper surface 16, such as illustrated by recessed channel 31, which are configured to receive pneumatic lines (not illustrated) to supply air to air ballast tanks (not illustrated) which may be disposed at various locations along lower surface 18 of port 10. In examples, recessed channels 31 include vertical channels 31*a* extending therefrom which pass vertically through port 10 from the upper surface 16 to lower surface 18 to air ballast tank locations. In examples, air may be directed to/from the ballast tanks via the pneumatic lines to adjust a buoyancy of port 10.

In one example, a pair of entrance wheels 32, illustrated as port and starboard entrance wheels 32*a* and 32*b*, are disposed in corresponding recessed wheel pockets 34*a* and 34*b* on angled port and starboard sidewalls 24*a* and 24*b* of hull depression 22 at the entrance to inlet 30. In one example, two pairs of opposing rows of recessed wheel pockets extend longitudinally along and symmetrically about longitudinal centerline 20 on port and starboard sidewalls 24*a* and 24*b* of hull depression 22, with a first pair of opposing rows of wheel pockets 36 illustrated as port and starboard rows of wheel pockets 36*a* and 36*b*, and a second pair of opposing rows of wheel pockets 37 illustrated as port and starboard rows of wheel pockets 37*a* and 37*b*. In one example, port and starboard rows 36*a* and 36*b* are disposed at a first distance from longitudinal centerline 20, and port and starboard rows 37*a* and 37*b* are disposed at second distance from longitudinal centerline 30, where the second distance is greater than the first distance.

In examples, a plurality of wheels 38 (which may also be referred to as hull wheels) are selectively disposed within the wheel pockets of one of the pairs of opposing port and starboard rows of wheel pockets 36 and 37. In examples, wheels 38 are disposed either in each wheel pocket 36 of the first pair of port and starboard rows of wheel pockets 36*a* and 36*b* (as illustrated by the Figures throughout), or in each wheel pocket 37 of the second pair of port and starboard rows of wheel pockets 37*a* and 37*b*, to form parallel rows of hull wheels 38 extending longitudinally along opposing sides of longitudinal centerline 20.

In examples, for a watercraft having a narrower/deeper v-hull, hull wheels 38 may be selectively disposed (or installed) within each wheel pocket 36 of the first pair of port and starboard rows of wheel pockets 36*a* and 36*b*, while for watercraft having a flatter hull, hull wheels 38 may be selectively disposed (or installed) within each wheel pocket 37 of the second pair of port and starboard rows of wheel pockets 37*a* and 37*b*. As illustrated in FIGS. 1 and 2, a plurality of port hull wheels 38*a* and a plurality of starboard hull wheels 38*b* are respectively illustrated as being disposed within the first pair of port and starboard rows of wheel pockets 36*a* and 36*b*. As mentioned above, the plurality of port wheels 38*a* and the plurality of starboard wheels 38*b*, are collectively referred to herein as hull wheels 38 as they engage the hull during transport and stowage of watercraft on port 10.

Figure 3:
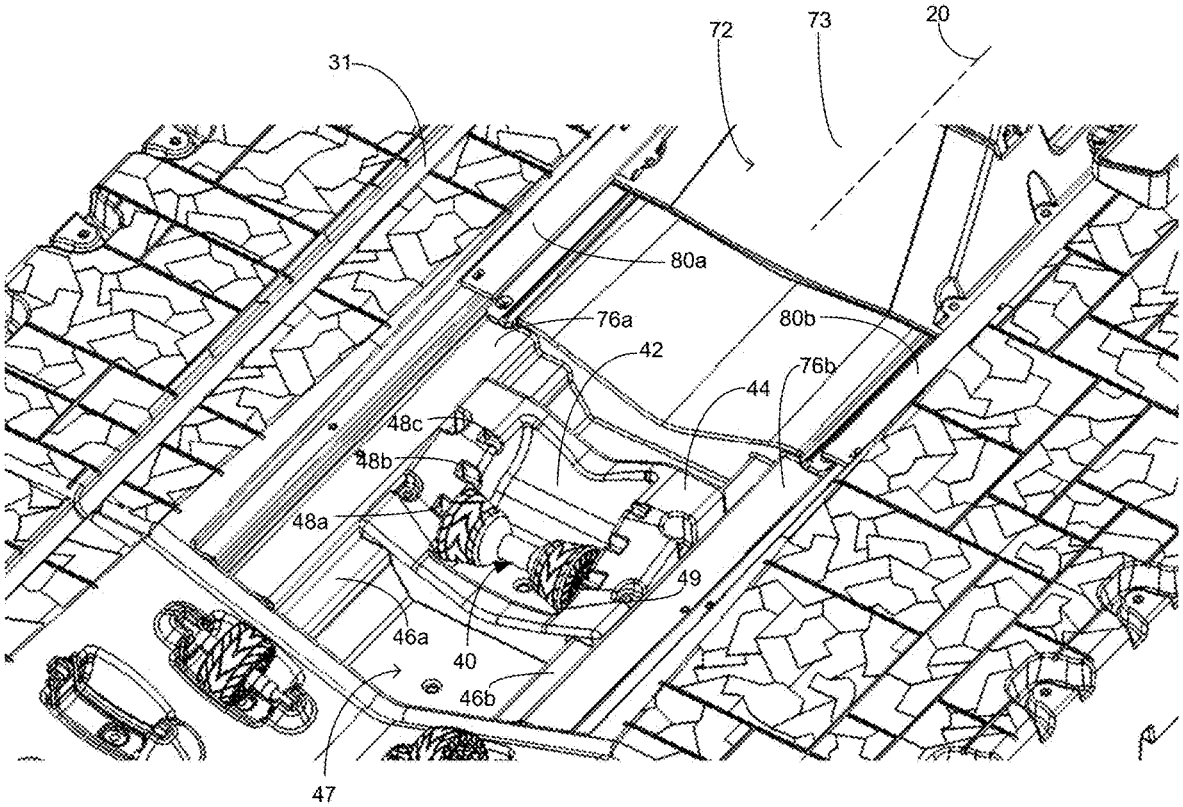
FIG. 3 is an enlarged perspective view illustrating a portion of a floating watercraft port, including an adjustable keel roller, according to one example of the present disclosure.

In one example, with additional reference to FIG. 3, a keel roller 40 is disposed along longitudinal centerline 20 between a forward end (i.e., toward bow end 29 of port 10) of the port and starboard rows 36*a* and 36*b* of hull wheels 38 and a bow stop assembly 70 (which will be described in greater detail below), wherein a rotational axis of keel roller 40 is perpendicular to longitudinal centerline 20. In one example, as illustrated, keel roller 40 is disposed within a keel roller pocket 42 of a moveable carriage 44. In examples, moveable carriage 44 is moveable back and forth along longitudinal centerline 20 over a keel roller adjustment range via sliding of moveable carriage 44 along a pair of rails 46*a* and 46*b*. In examples, carriage 44 is moveable back and forth along centerline 20 within a recessed channel 47 in upper surface 16 of floating port 10. Such adjustability enables keel roller 40 to be positioned at an optimal location along longitudinal center line 20 for a particular hull configuration of a given watercraft being stored on port 10. In examples, once an optimal longitudinal location of keel roller 40 is determined, carriage 44 can be secured to rails 46*a* and 46*b* via any suitable fastening means to prevent movement of carriage 44, such as via screws inserted through a plurality of screw cavities (such as illustrated by screw cavity 49) into rails 46*a* and 46*a*, for example.

In one example, keel roller pocket 42 within carriage 44 includes a plurality of roller axle slots 48, illustrated as axle slots 48*a*-48*c*, into which keel roller 40 may be selectively mounted, where each axle slot is at a different vertical position (height). As illustrated, each axle slot 48*a*-48*c* is successively disposed vertically higher such that axel slot 48*a* positions keel roller 40 at a lowest vertical position and axel slot 48*c* positions keel roller 40 at a highest vertical position. The optimal vertical position of keel roller 40 for a particular hull configuration of a given watercraft being stored on port 10 can be achieved by selectively placing keel roller 40 in one of the plurality of axle slots 48. Although illustrated as having three axle slots 48*a*-48*c*, it is noted that carriage 44 may include more or fewer than three axle slots 48 so as to provide more or fewer than three vertical positions. Vertical and horizontal adjustability of keel roller 40 enables keel roller 40 to be positioned at a location to direct a bow of a particular watercraft being stored on port 10 to contact a contact surface 73 of a bow stop 72 of bow stop assembly 70 (as will be described in greater detail below).

Together, entrance wheels 32, hull wheels 38 of port and starboard wheel pocket rows 36*a* and 36*b*, and keel roller 40 form a transport track 50 which guides, supports, and transports a hull of a watercraft onto, along, and above upper surface 16 of port 10 during loading and launching operations of the watercraft, and which supports the hull of the watercraft when stowed thereon. In examples, a longitudinal centerline of transport track 50 is coincident with longitudinal centerline 20 of floating port 10. In one example, entrance wheels and hull wheels 32 and 38 comprise "wobble wheels", such as disclosed by U.S. patent application Ser. No. 17/465,553, and keel roller 40 comprises a "bowtie roller", such as disclosed by U.S. patent application Ser. No. 17/465,566, each of which are incorporated in their entirety herein.

Figure 4A:
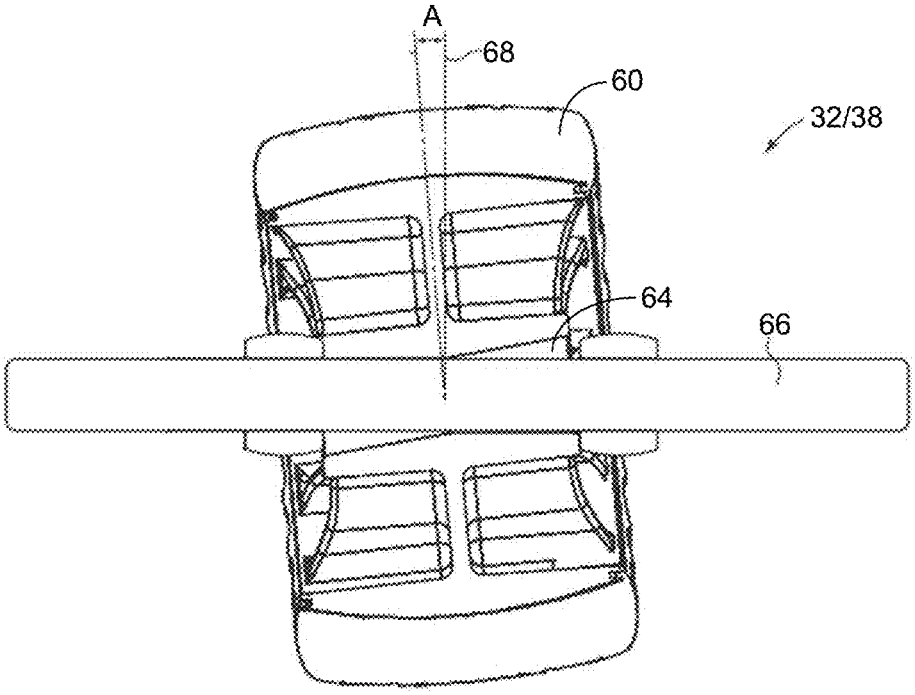
FIGS. 4A and 4B are cross-sectional views illustrating a wobble wheel for use with a floating watercraft port, according to one example of the present disclosure.
Figure 4B:
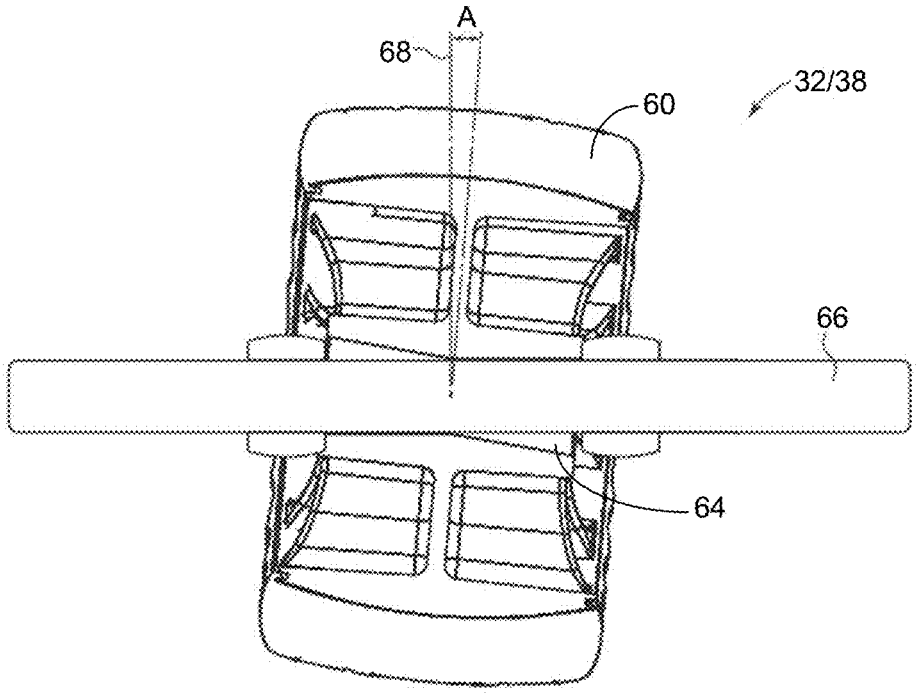

FIGS. 4A and 4B illustrate an example of entrance wheels 32 and hull wheels 38 when implemented as a wobble wheel as disclosed by U.S. patent application Ser. No. 17/465,553. As illustrated, according to such example, entrance and hull wheels 32/38 include a tire 60 disposed about a rim 62 having a tapered hub 64 extending there through which receives an axle 66, wherein the tapered hub 64 enables rim 62 and tire 60 to "wobble" back and forth by a wobble angle, A, relative to an axis 68 extending perpendicularly to axle 66. In one example, angle A may be 2.5-degrees, such that entrance and hull wheels 32/38 can tilt back and forth over a 5-degree wobble range.

Figure 5:
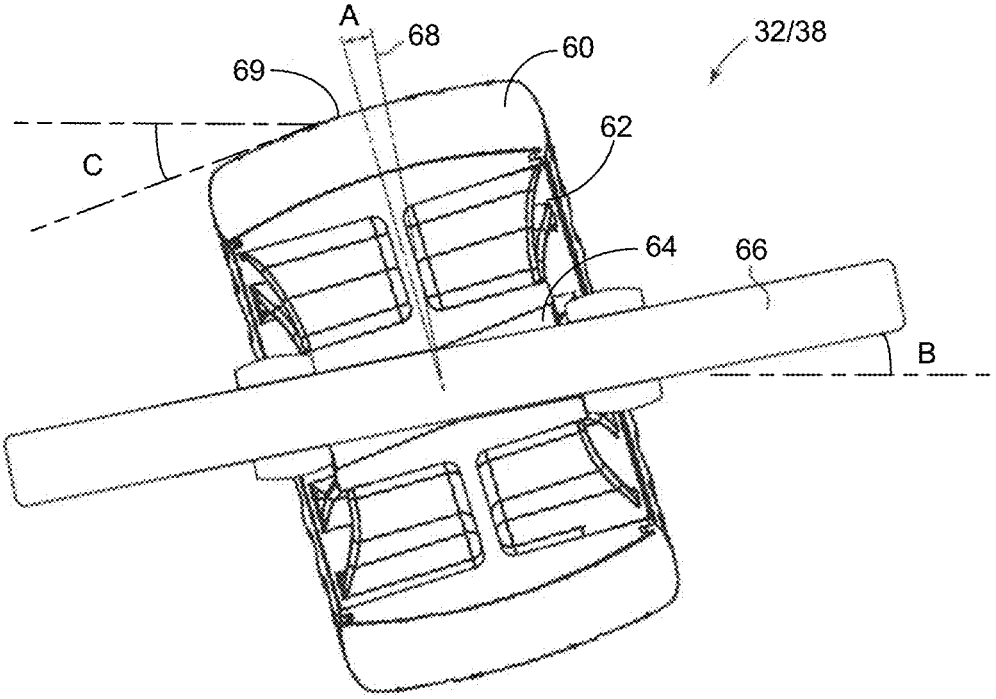
FIG. 5 is a cross-sectional views illustrating a wobble wheel for use with a floating watercraft port, according to one example of the present disclosure.

With reference to FIG. 5, according to one example of the present disclosure, the wheel pockets 36 of the first pair of port and starboard rows of wheel pockets 36*a* and 36*b*, and the wheel pockets 37 of the second pair of port and starboard rows of wheel pockets 37*a* and 37*b* recessed within hull depression 22 are each formed to hold axle 66 of entrance and hull wheels 32/38 at an axle angle, B, relative to horizontal (e.g., relative to the water surface). As a result, a circumferential surface 69 of each tire 60 of entrance and hull wheels 32/38 can tilt back and forth over a range of angles, referred to herein as a wheel tilt range C, where C=B+/−A. For example, if axle 66 is positioned by a corresponding wheel pocket at an axle angle, B, of 18-degrees relative to horizontal (B=18), and wobble wheel 32/38 has a wobble angle, A, of 2.5-degrees in each direction relative to axle 66 (A=2.5), the surface 69 of wobble wheel 32/38 has a tilt range, C, of 15.5 degrees to 20.5 degrees relative to horizontal (C=[18.0−2.5] to [18.0+2.5]).

In one example, the axle angle, B, at which the wheel pockets of the first and second pairs of port and starboard rows of wheel pockets 36*a*/36*b* and 37*a*/37*b* hold axle 66 of corresponding port and starboard hull wheels 38*a* and 38*b* relative to horizontal successively increases with each wheel pocket in a direction from tapered entrance inlet 30 toward keel roller 40. As a result, the angles of the tilt range, C, over which the surface 69 of wobble wheels 38 tilt become greater the closer the wobble wheel 38 is to keel roller 40 to reflect the typical characteristic that hulls of watercraft are generally narrower and more steeply angled at the bow and generally wider and less steeply angled at the stern. In on example, the wheel pockets 36/37 closet to entrance inlet 30 have an axle angle, B, of 18-degrees such that the wobble wheels 38 disposed therein have a tilt range of 15.5 to 20.5 degrees, and the wheel pockets 36/37 closest to keel roller 40 have an axle angle, B, of 20-degrees such that the wobble wheels 38 disposed therein have a tilt range of 17.5 to 22.5 degrees (i.e., a tilt range steeper than that of wobble wheels at tapered entrance inlet 30). It is noted that the tilt range, C, refers to the range of angles over which entrance and hull wheels 32/38 are able to tilt relative to axle 66 (wherein the wheels tilt toward and away from longitudinal centerline 20 of port 10).

In one example, the axle angle, B, of groups of wheel pockets 36/37 gets steeper as one moves from tapered entrance inlet 30 toward keel roller 40. For example, in one case, the first two wheel pockets of port and starboard rows of wheel pocks 36*a*/36*b* and 37*a*/37*b* have an axle angle, B, of 18 degrees, the final two wheel pockets of port and starboard rows of wheel pocks 36*a*/36*b* and 37*a*/37*b* have an axle angle, B, of 20 degrees, and the middle three wheel pockets of port and starboard rows of wheel pocks 36*a*/36*b* and 37*a*/37*b* have an axle angle, B, of 19 degrees.

In one example, by configuring wheel pockets of port and starboard rows of wheel pocks 36*a*/36*b* and 37*a*/37*b* to increase the steepness of the tilt range, C, of the surface 69 of wobble wheels 38 disposed therein as one moves from tapered entrance inlet 30 toward keel roller 40 enables the transport track 50 to better conform to typical hull contours (which are generally narrower and more steeply angled at the bow and generally wider and less steeply angled at the stern).

Although specific axle angles, B, are described herein, such axle angles are for purposes of example, and any suitable axle angle, or combination of axle angles, may be employed. For example, in some cases, the axle angle, B, is the same for each wheel pocket of port and starboard rows of wheel pocks 36*a*/36*b* and 37*a*/37*b*. In other examples, the axle angle, B, of the inner rows of port and starboard wheel pockets 36*a*/36*b* vary over the length of the rows, while the axle angle, B, of the outer rows of port and starboard wheel pockets 37*a*/37*b* are the same over the length of the rows. One example implementation of axle angles, B, for inner rows of port and starboard wheel pockets 36*a*/36*b* and outer rows of port and starboard wheel pockets 37*a*/37*b* is illustrated in greater detail below by FIGS. 10 to 11J.

Returning to FIGS. 1 and 2, and with additional reference to FIGS. 6-8 (and also FIG. 3), according to examples of the present disclosure, floating watercraft port 10 further includes a bow stop assembly 70 including a moveable bow stop 72 that can be driven back-and-forth along longitudinal centerline 20 of port 10 by an actuating system 74 (see FIGS. 6-9 below). In examples, components of actuating system 74 are disposed within a space internal to bow stop 72 which is accessible via a removable cover 75. In examples, as will be described in greater detail below, bow stop 72 can be driven back-and-forth along bow stop rails 76*a* and 76*b* by actuating system 74 to assist watercraft in launching from port 10 and/or in landing on port 10. In one example, bow stop 72 includes a tie-down 77 to which cables may secured to assist in securing a watercraft to port 10 and, in some examples, as will be described in greater detail below, may assist with landing of a watercraft on port 10. In examples, bow stop assembly 70 additionally includes a bow stop bar 78 and a pair of containment rails 80*a* and 80*b*.

In examples, bow stop assembly 70, as a whole, is horizontally moveable back-and-forth along bow stop rails 76*a* and 76*b* to enable a position of bow stop 72 along longitudinal centerline 20 to be adjusted to conform to the position of a bow of watercraft when in a stowed position on port 10. Once bow stop assembly 70 is positioned at an optimal horizontal position along longitudinal centerline 20 (where bow stop 72 is aligned with the bow of the watercraft when at the desired stowed position on port 10), bow stop bar 78 is secured to bow stop rails 76*a* and 76. As will be described in greater detail below (see FIGS. 8 and 9), once secured to bow stop rails 76*a* and 76*b*, bow stop bar 78 defines what is referred to herein as the "home" position of bow stop 72 (i.e., the furthest position along longitudinal centerline 20 that bow stop 72 can travel in the direction of bow end 29 of floating watercraft port 10). In examples, when at the home position, a contact surface 73 of bow stop 72 is positioned to be in contact with the bow of a watercraft being stowed on port 10, where contact surface 73 defines the forward end (i.e., in the direction of bow end 29 of port 10) of transport track 50. In examples, surface 73 of bow stop 72 comprises an elastic material which in configured to absorb impact forces from a bow of a watercraft when being driven onto port 10. In examples, a distance along longitudinal centerline 20 over which the home position of bow stop 72 may be adjusted may be referred to as a "home position range".

In one example, once the home positioned is determined and bow stop bar 78 is secured to bow stop rails 76*a* and 76*b*, containment rails 80*a* and 80*b* are secured over bow strop rails 76*a* and 76*b* to constrain vertical movement of bow stop 72 and thereby "lock in" and confine movement bow stop 72 to horizontal movement along bow stop rails 76*a* and 76*b*. In one example, containment rails 80*a* and 80*b* may also be employed to secure bow stop bar 78 to bow stop rails 76*a* and 76*b*.

Figure 6:
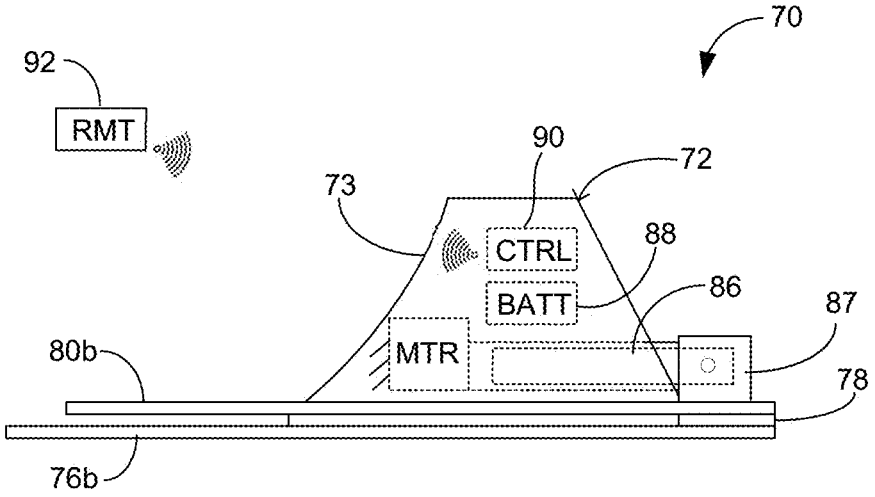
FIG. 6 is a block and schematic diagram generally illustrating an actuated bow stop when at a home position, according to one example.
Figure 7:
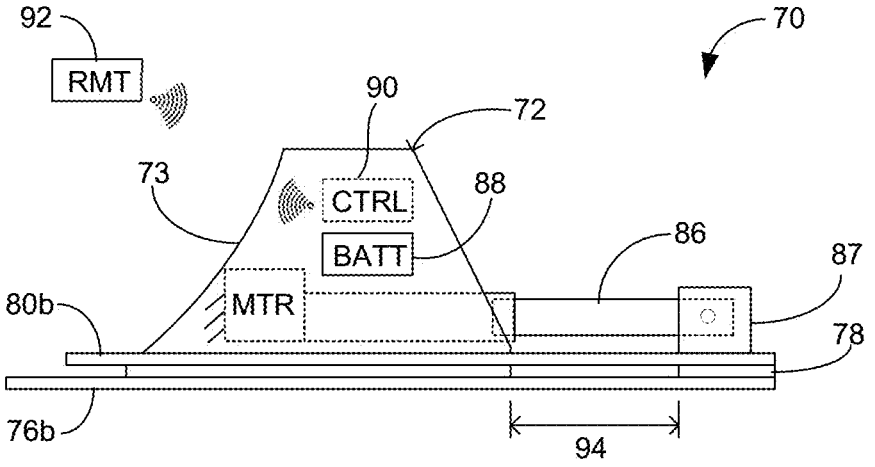
FIG. 7 is a block and schematic diagram generally illustrating an actuated bow stop when at an extended position, according to one example.

FIGS. 6 and 7 are block and schematic diagrams generally illustrating bow stop assembly 70 and the operation thereof, according one example of the present disclosure. With reference to FIG. 6, bow stop 72 is illustrated in a "home" position where bow stop 72 is contact with bow stop bar 78 (and which corresponds to the position of bow stop 72 illustrated by FIGS. 2 and 8). Bow stop bar 78 is secured to bow stop rails 76*a* and 76*b*, and containment rails 80*a* and 80*b* contain bow stop 72 to horizontal movement along blow stop rails 76*a* and 76*b* (it is noted that only bow stop rails 76*b* and containment rail 80*b* are shown in FIGS. 6 and 7). In one example, actuation system 74 includes an electric motor 84, an extendable drive track 86, a battery 88, and a controller 90. In one example, a bow end of drive track 86 is pivotally coupled to bow stop bar 78 via a bracket 87, and electric motor 84 being coupled to an opposing stern end of drive track 86, with electric motor 84 further being mounted to bow stop 72. In one example, motor 84, battery 88, and controller 90 are disposed in an internal space within bow stop 72 which is accessible via removable cover 75 (see FIG. 1, for example). In one example, electric motor 84 is a DC stepper motor powered by rechargeable DC battery 88. In one example, in lieu of a battery, a DC power supply may be employed which is fed from an external AC power source (e.g., via a plug and cord connection). In one example, actuator system 74 is remotely controlled via a wireless remote control 92. In other examples, actuator system 74 may be controlled by a hardwired switch (not shown) and/or by remote control 92.

In one example, upon controller 90 receiving a control input (such as via remote control 92) to move bow stop 72 from a home (or retracted) position (as illustrated by FIG. 6), controller 90 operates motor 84 to extend drive track 86 to move bow stop 72 away from bow stop bar 78 (i.e., away from bow end 29 of port 10) and to an extended position toward entrance end 28 of port 10, as illustrated by FIG. 7. In one example, motor 84 drives a threaded screw (e.g., a worm drive) to extend and retract drive track 86. In examples, bow stop 72, via actuator system 74, can be horizontally driven back-and-forth over a bow stop drive range 94. In examples, bow stop drive range 94 may be any suitable distance (such as 18 inches, 24 inches, 30 inches, etc.). In one example, controller 90 may instruct motor 84 to extend drive track 86 to different preset distances in response to different control inputs (e.g., to 18 inches in response to one input signal, to 24 inches in response to another input signal). In other examples, controller 90 instruct may instruct motor 84 to extend drive track 86 to any distance within bow stop drive range 94 (e.g., motor 84 continues to extend drive track 86 within drive range 94 in response to a button/switch continuing to be pressed/operated).

Figure 8:
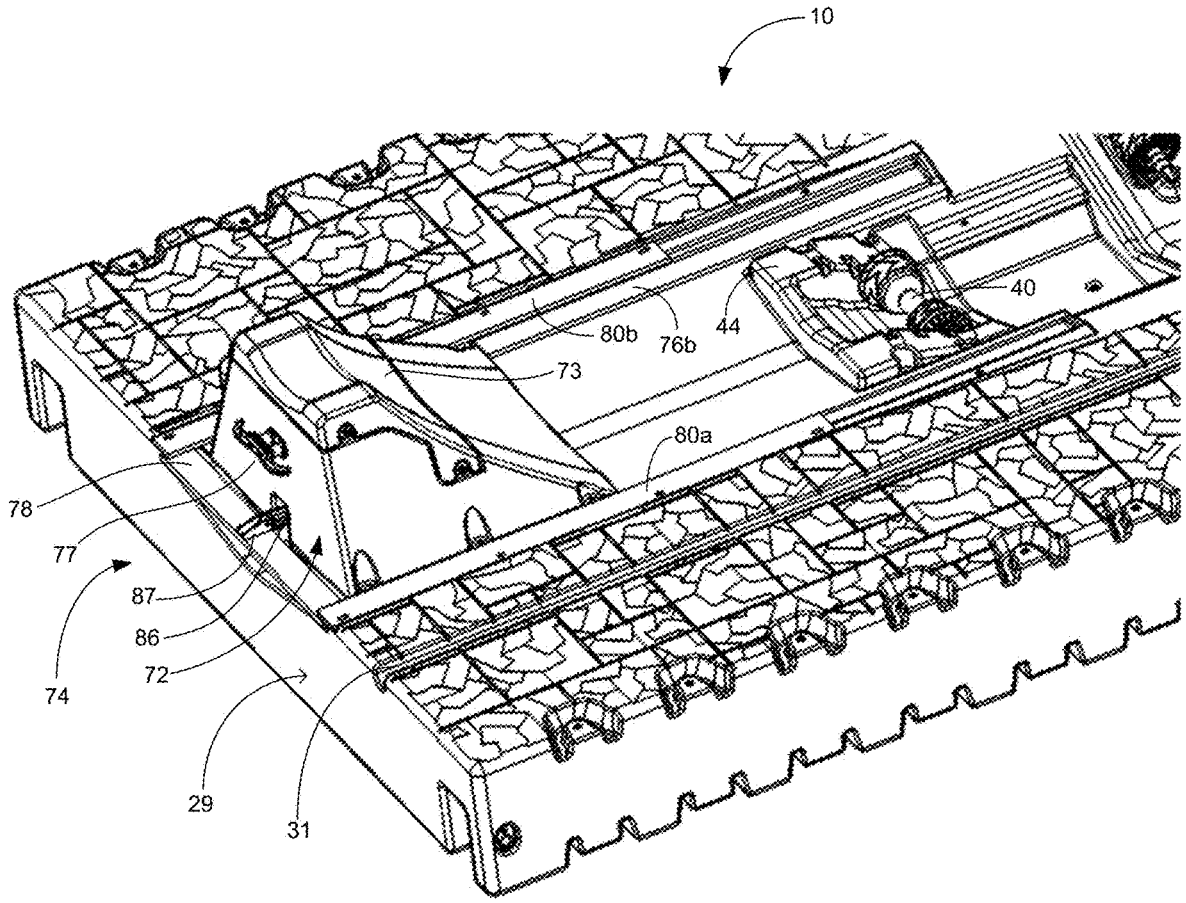
FIG. 8 is a perspective view illustrating portions of a floating watercraft porting including illustrating an actuated bow stop at a home position, according to one example.
Figure 9:
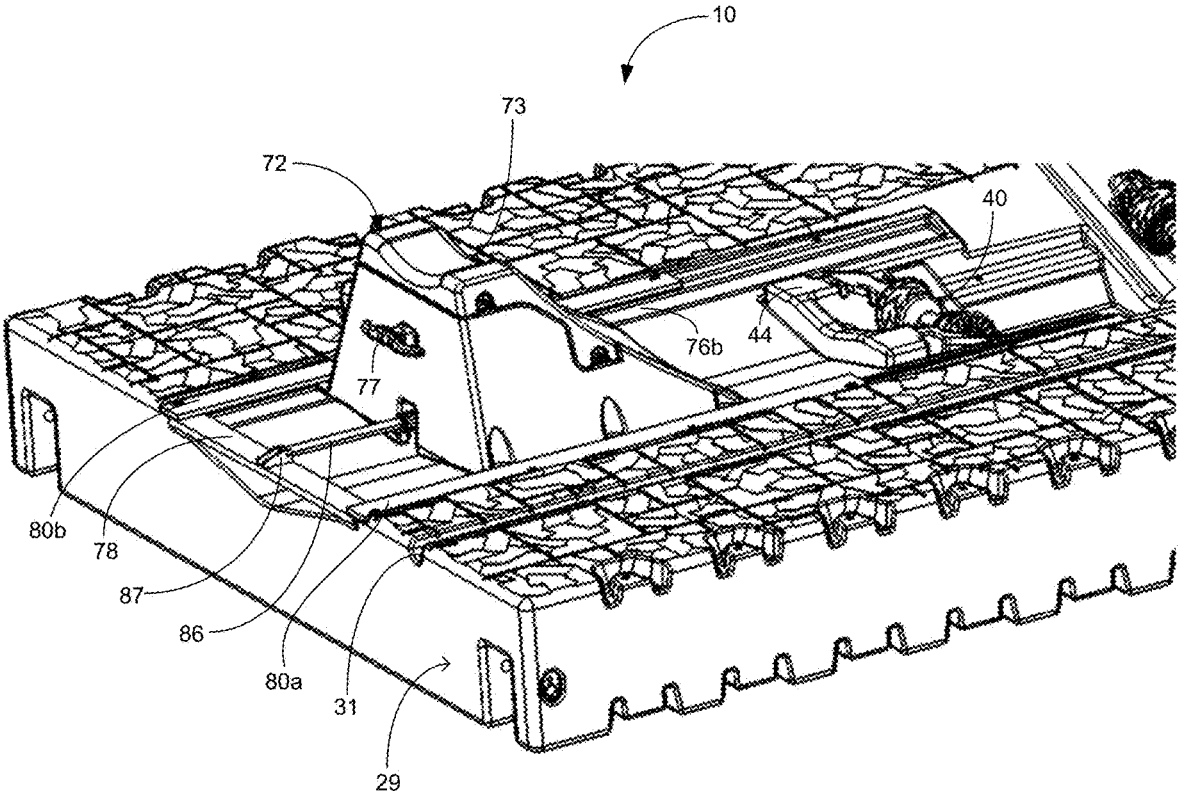
FIG. 9 is a perspective view illustrating portions of a floating watercraft port including illustrating an actuated bow stop at an extended position, according to one example.

FIGS. 8 and 9 are perspective views illustrating portions of floating watercraft port 10, and in particular, illustrating bow stop assembly 70 in greater detail, and respectively illustrating bow stop 72 at a home position and an extended position.

During landing of a watercraft on floating watercraft port 10 (also referred to as a loading or docking operation), tapered entry inlet 30 (see FIGS. 1 and 2) receives and directs the bow of the watercraft to align with longitudinal centerline 20 of port 10. As the boat continues to be driven forward, entrance rollers 32 engage opposing sides of the hull and begin to lift the leading portion of the bow and keel out of the water and direct the hull onto the opposing port and starboard rows of rollers 38*a* and 38*b* (it is noted that for watercraft having wider hulls, the port and starboard rows of rollers 38*a* and 38*b* may be positioned in the port and starboard rows of wheel pockets 37*a*/37*b* in lieu of the port and starboard rows of wheel pockets 36*a*/36*b*).

As the watercraft continues to be driven forward by its onboard propulsion system, the hull of the watercraft continues to be move along the port and starboard rows of rollers 38*a* and 38*b* of transport path 50, with the port and starboard rows of wheels engaging and directing the hull along longitudinal centerline 20 (via the downwardly angled surfaces of the wheels, as illustrated by FIG. 5, for example). Upon the bow reaching keel roller 40, keel roller 40 engages the keel of the hull and vertically lifts the hull as the watercraft continues to be driven forward. In one example, upon engaging contact surface 73 of bow stop 72, an operator of the watercraft stops the propulsion system with the hull of the watercraft resting against bow stop 72.

In one case, during the landing process, bow stop 72 may be positioned at the home position. In such case, upon the hull contacting and coming to rest against bow stop 72, the watercraft will be in the stowed (or storage) position on floating watercraft port 10, at which point the watercraft may be secured to port 10 (via a number of tie-downs, for example).

In another case, during the landing process, such as when the propulsion system of the watercraft is unable to propel the watercraft fully to the stowed position, bow stop 72 may be positioned at an extended position (e.g., actuated via remoted control 92 to an extended position toward keel roller 40 from home position). In such case, upon the hull contacting and coming to rest against bow stop 72, the watercraft is coupled to bow stop 72, such as via a rope connected to tie-down 77 on bow stop 72. Upon being coupled to bow stop 72, actuation system 74 is actuated to move bow stop 72 to the home position, pulling the watercraft therewith along transport path 50 to the stowed position.

In one example, during launching of a watercraft from floating watercraft port 10, actuating system 74 drives bow stop 72 from the home position toward keel roller 40 and pushes the watercraft via the bow until the stern of the watercraft is positioned in the water and the watercraft's propulsion system (e.g., propeller or water jet) is able to pull the watercraft off port 10 and into the water without further assistance. In the case of a jet boat, for example, the bow stop pushes the boat far enough so that the propulsion system engages the water. Upon the watercraft being launched from port 10, an operator of the watercraft may, via remote control 92, return bow stop 72 to the home position (or leave bow stop 72 in the extended position to assist with landing).

Although actuating system 74 is described primarily herein as comprising an electric motor (e.g., battery powered) driving a linear actuator (e.g., drive track 86), other suitable actuating means may be employed. For example, pneumatic and/or hydraulic pistons, springs, hand crank systems, and any number of other suitable actuating means, both linear and non-linear, may be employed. Additionally, it is noted that any number of other suitable driven elements other than, or in addition to, a bow stop may be employed to contact the watercraft to push and/or pull the watercraft along the transport path, such as a rope/cable and pulley system that may be driven in forward and reverse directions, for example. Furthermore, although illustrated primarily herein with respect to a floating port having a single transport track (e.g., transport track 50), it is noted that powered launch and/or landing assist system (e.g., the powered bow stop) may be adapted for use with ports having multiple transport tracks (for multi-hull watercraft, such as pontoon boats, for example), where a powered launch element (such as bow stop 72) may be employed with each transport track.

Figure 10:
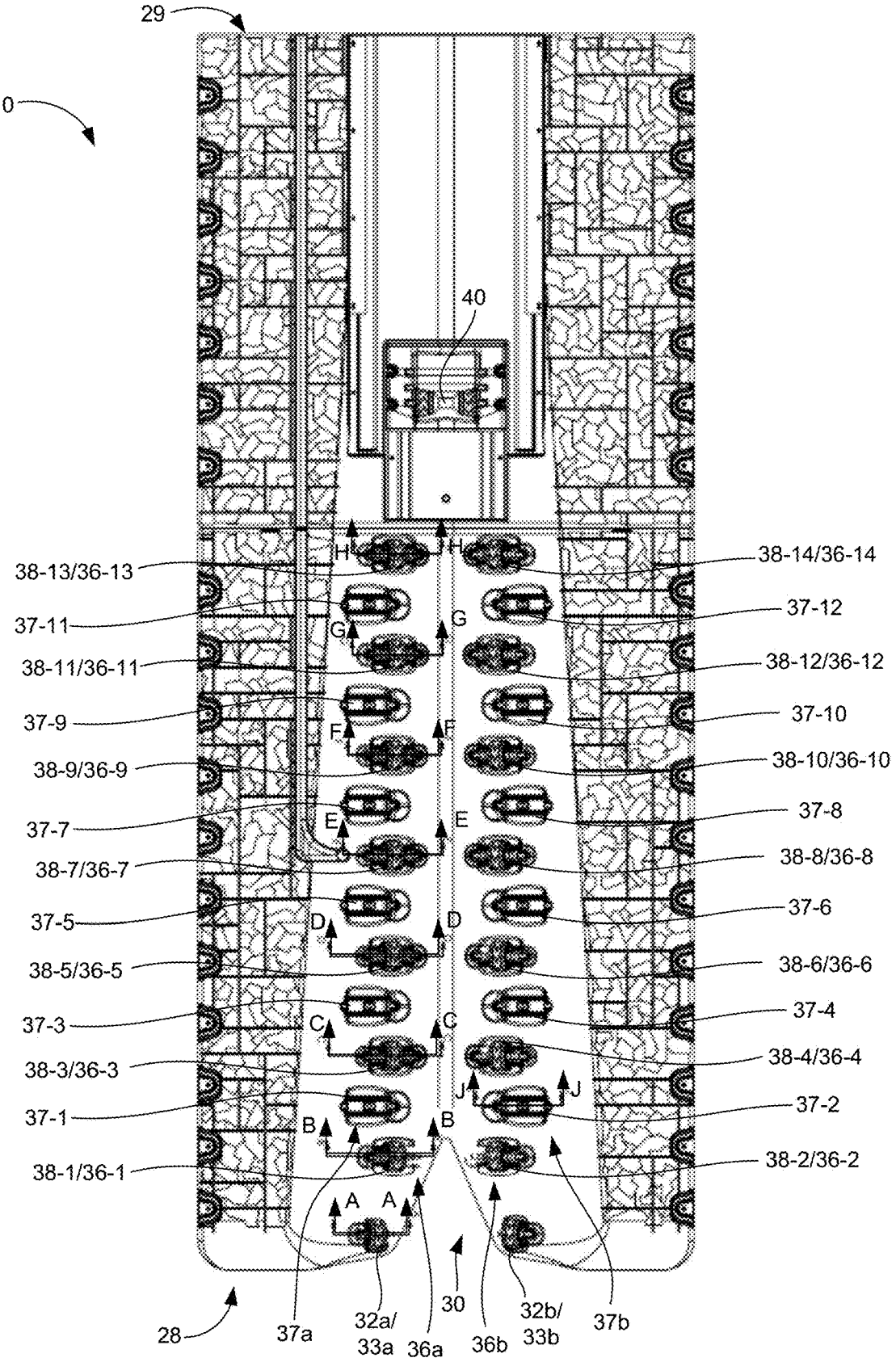
FIG. 10 is a top view of a floating watercraft port illustrating recessed wheel pockets in greater detail, according to one example.

FIGS. 10 and 11A-11J illustrate in greater detail one example implementation of axle angles, B, for inner rows of port and starboard wheel pockets 36*a*/36*b* and outer rows of port and starboard wheel pockets 37*a*/37*b* of watercraft port 10. FIG. 10 is a top view of floating watercraft port 10 illustrating inner and outer port and starboard rows of recessed wheel pockets 34*a*/34*b* and 36*a*/36*b*, and FIGS. 11A-11J illustrate cross-sectional views of individual wheel pockets of inner row of port wheel pockets 36*a* and outer row of wheel pockets 37*b*.

Referring to FIG. 10, port and starboard entrance wheels 32*a* and 32*b* are illustrated as being installed in corresponding wheel pockets 33*a* and 33*b* at the entrance to inlet 30. Inner port row of wheel pockets 36*a* is illustrated as including wheel pockets 36-1, 36-3, 36-5, 36-7, 36-9, 36-11 and 36-13 with corresponding hull wheels 38-1, 38-3, 38-5, 38-7, 38-9, 38-11 and 38-13 installed therein, and the inner starboard row of wheel pockets 36*b* is illustrated as including wheel pockets 36-2, 36-4, 36-6, 36-8, 36-10, 36-12 and 36-14 with corresponding hull wheels 38-2, 38-4, 38-6, 38-8, 38-10, 38-12 and 38-14 installed therein. Outer port row of wheel pockets 37*a* is illustrated as including wheel pockets 37-1, 37-3, 37-5, 37-7, 37-9 and 37-11, and outer starboard row of wheel pockets 37*b* is illustrated as including wheel pockets 37-2, 37-4, 37-6, 37-8, 37-10 and to 37-12.

As illustrated by the cross-sectional views of FIGS. 11A-11J, the recessed wheel pockets of entrance wheels 32*a* and 32*b*, and of inner and outer port and starboard rows 36*a*/36*b* and 37*a*/37*b* are each configured to hold axle 66 of the corresponding hull wheel 38 at axle angles, B, which vary between wheel pockets across a length of inner and outer port and starboard rows 36*a*/36*b* and 37*a*/37*b* from stern end 28 toward bow end 29 of port 10.

Figure 11A:
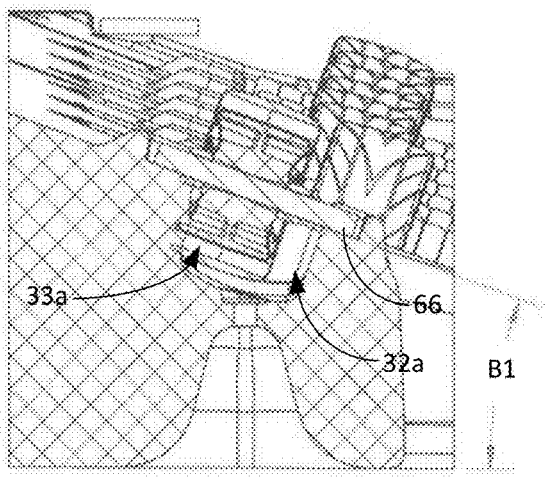

FIG. 11A illustrates cross-sectional view A-A (see FIG. 10) through the recessed wheel pocket 33*a* in which entrance roller 32*a* is installed. As shown in FIG. 11A, according to the illustrated example, recessed wheel pocket 33*a* is configured to hold axle 66 of entrance wheel 32*a* at an axle angle, B1, to horizontal. In one example, axle angle B1 is 20 degrees.

Figure 11B:
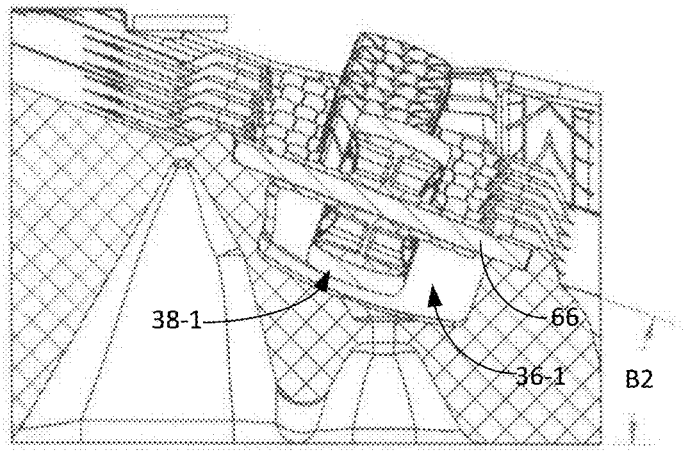

FIG. 11B illustrates cross-sectional view B-B (see FIG. 10) through the recessed wheel pocket 36-1 in which hull roller 38-1 is installed. As shown in FIG. 11B, according to the illustrated example, recessed wheel pocket 36-1 is configured to hold axle 66 of hull wheel 38-1 at an axle angle, B2, to horizontal. In one example, axle angle B2 is 20 degrees.

Figure 11C:
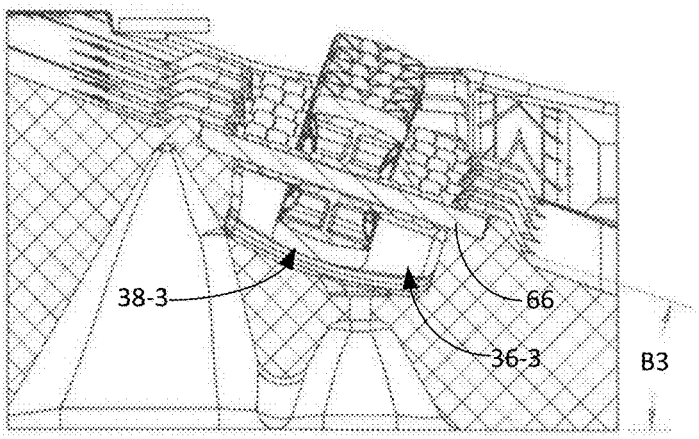
Figure 11D:
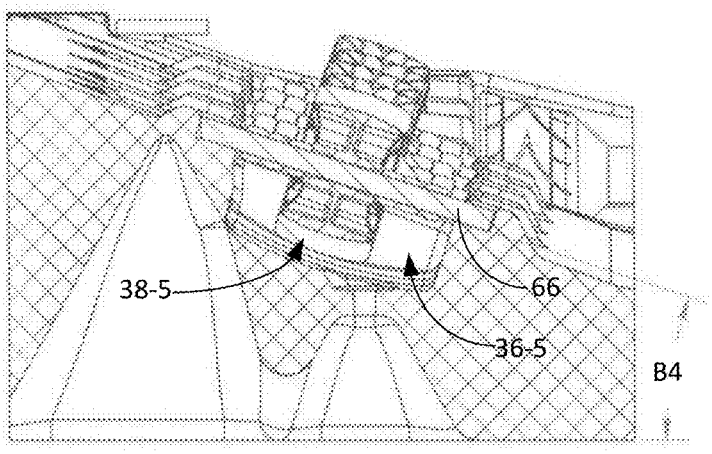

FIG. 11C illustrates cross-sectional view C-C (see FIG. 10) through the recessed wheel pocket 36-3 in which hull roller 38-3 is installed. As shown in FIG. 11C, according to the illustrated example, recessed wheel pocket 36-3 is configured to hold axle 66 of hull wheel 38-3 at an axle angle, B3, to horizontal. In one example, axle angle B3 is 18 degrees. FIG. 11D illustrates cross-sectional view D-D (see FIG. 10) through the recessed wheel pocket 36-5 in which hull roller 38-5 is installed. As shown in FIG. 11D, according to the illustrated example, recessed wheel pocket 36-5 is configured to hold axle 66 of hull wheel 38-5 at an axle angle, B4, to horizontal. In one example, axle angle B4 is 18 degrees.

Figure 11E:
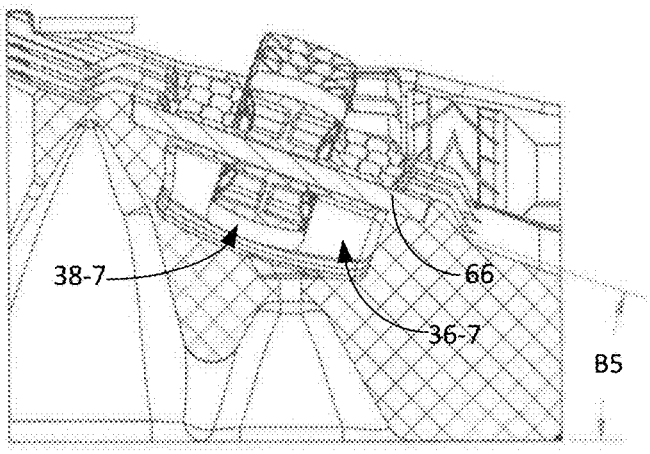
Figure 11F:
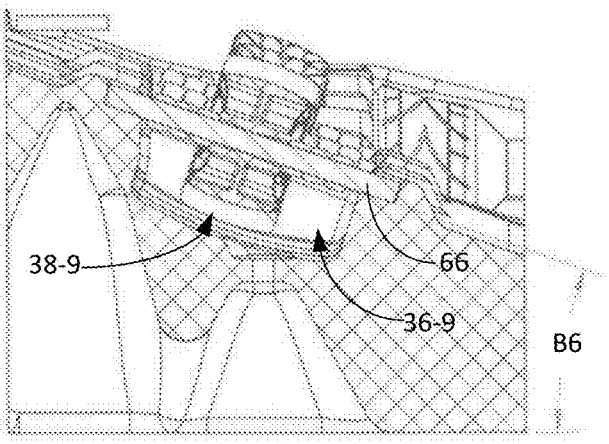

FIG. 11E illustrates cross-sectional view E-E (see FIG. 10) through the recessed wheel pocket 36-7 in which hull roller 38-7 is installed. As shown in FIG. 11D, according to the illustrated example, recessed wheel pocket 36-7 is configured to hold axle 66 of hull wheel 38-7 at an axle angle, B5, to horizontal. In one example, axle angle B5 is 19 degrees. FIG. 11F illustrates cross-sectional view F-F (see FIG. 10) through the recessed wheel pocket 36-9 in which hull roller 38-9 is installed. As shown in FIG. 11F, according to the illustrated example, recessed wheel pocket 36-9 is configured to hold axle 66 of hull wheel 38-9 at an axle angle, B6, to horizontal. In one example, axle angle B6 is 19 degrees.

Figure 11G:
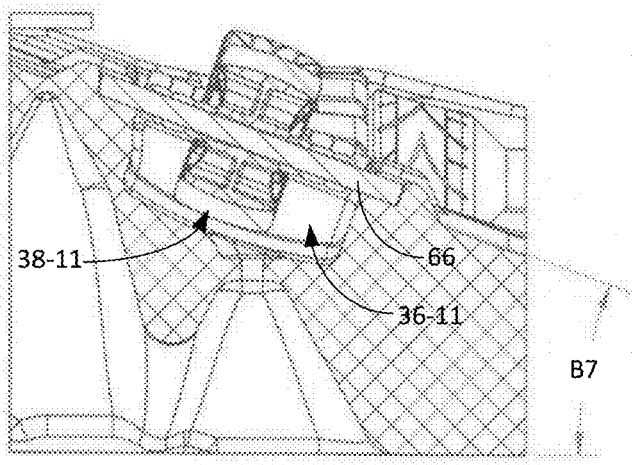
Figure 11H:
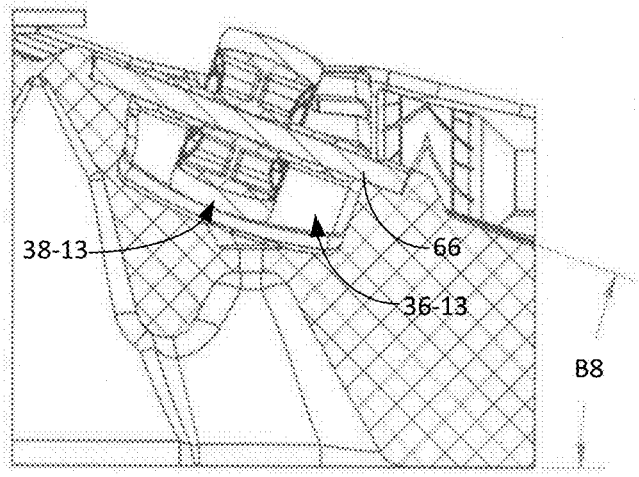

FIG. 11G illustrates cross-sectional view G-G (see FIG. 10) through the recessed wheel pocket 36-11 in which hull roller 38-11 is installed. As shown in FIG. 11G, according to the illustrated example, recessed wheel pocket 36-11 is configured to hold axle 66 of hull wheel 38-11 at an axle angle, B7, to horizontal. In one example, axle angle B7 is 20 degrees. FIG. 11H illustrates cross-sectional view H-H (see FIG. 10) through the recessed wheel pocket 36-13 in which hull roller 38-13 is installed. As shown in FIG. 11H, according to the illustrated example, recessed wheel pocket 36-13 is configured to hold axle 66 of hull wheel 38-13 at an axle angle, B8, to horizontal. In one example, axle angle B8 is 20 degrees.

Figure 11J:
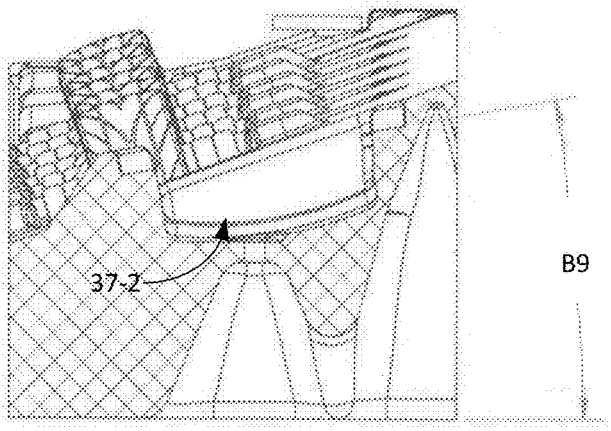

FIG. 11J illustrates cross-sectional view J-J (see FIG. 10) through the recessed wheel pocket 37-2 of outer starboard row of wheel pockets 37*b*. As shown in FIG. 11H, according to the illustrated example, recessed wheel pocket 37-2 is configured to hold axle 66 of a hull wheel, when installed therein, at an axle angle, B9, to horizontal. In one example, axle angle B9 is 10 degrees. In one example, each of the recessed wheel pockets 37-1 to 37-12 of outer port and starboard rows of wheel pockets 37*a* and 37*b* is configured to hold an axle of a hull wheel installed therein at a same axle angle, B9. In other examples, the axle angles of recessed wheel pockets 37-1 to 37-12 of outer port and starboard rows of wheel pockets 37*a* and 37*b* may vary similar to that described above with regard to the recessed wheel pockets 36-1 to 36-14 of inner port and starboard rows of wheel pockets 36*a* and 36*b*.

According to one example, as illustrated by FIGS. 10 and 11A-11J, inner port and starboard rows of wheel pockets 36*a*/36*b* are configured to provide hull wheels 38 with axle angles, B, suited for narrower hulled watercraft (with the angle of the hull wheels 38 increasing in steepness relative to horizontal from inlet 30 toward keel roller 40), and outer port and starboard rows of wheel pockets 37*a*/37*b* are configured to o provide hull wheels 38 with axle angles, B, suited for watercraft having wider and more flat-bottomed hulls.

Figure 12:
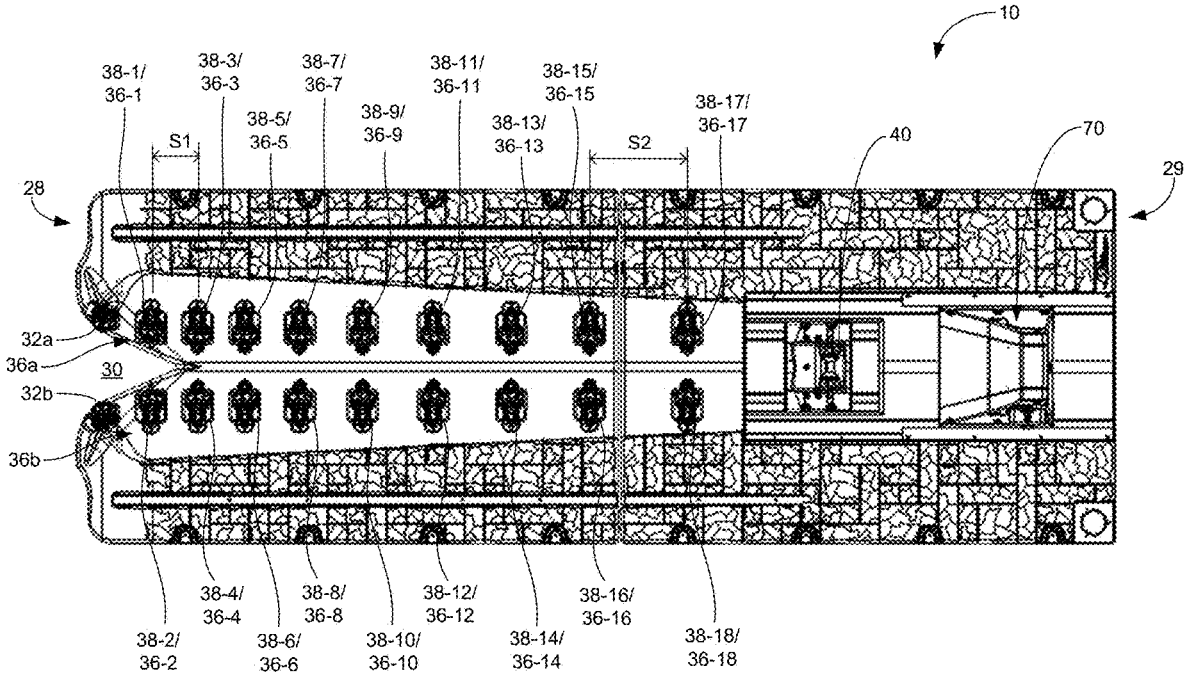
FIG. 12 is a top view of a floating watercraft port, according to one example.

FIG. 12 is a top view illustrating an example of floating watercraft port 10 which includes only a single pair of port and starboard rows of wheel pockets 36*a* and 36*b*. As illustrated, port row 36*a* includes odd-numbered recessed wheel pockets 36-1 to 36-17 with corresponding odd-numbered hull wheels 38-1 to 38-17 installed respectively therein, while starboard row 36*b* includes even-numbered recessed wheel pockets 36-2 to 36-18 with corresponding even-numbered hull wheels 38-2 to 38-18 installed respectively therein. In one example, a spacing between adjacent recessed wheel pockets of port and starboard rows 36*a* and 36*b* varies along the longitudinal length of port 10, where, as illustrated, in one case, a spacing, S1, at stern end 28 is closer than a spacing S2 at bow end 29 of port and starboard rows 36*a* and 36*b*. As with the earlier described examples, the recessed wheel pockets of port and starboard rows of wheel pockets 36 and 36*b* may have axle angles which vary over a length of the rows from stern end 28 toward bow end 29 of port 10, similar to that described above by FIGS. 10 to 11J.

Although specific embodiments have been illustrated and described herein, it will be appreciated by those of ordinary skill in the art that a variety of alternate and/or equivalent implementations may be substituted for the specific embodiments shown and described herein without departing from the scope of the present invention. This application is intended to cover any adaptations or variations of the specific embodiments discussed herein. Therefore, it is intended that this invention be limited only by the claims and the equivalents thereof.

What is claimed is:

1. A drive-on floating watercraft port comprising:

a plurality of floating sections hinged together in an articulating fashion and extending longitudinally between a stern end and a bow end, the plurality of floating sections together defining an upper surface;

a transport track extending across the upper surface from the stern end toward the bow end, the transport track to carry and guide a hull of a watercraft across the upper surface;

a moveable bow stop disposed at a home position along a length of the transport track, the bow stop to define a bow end of the transport track; and an actuator system to selectively drive the bow stop back and forth between the home position and an extended positioned to apply a force to a watercraft to move the watercraft along the transport track.

2. The floating watercraft port of claim 1, wherein the extended position is between the home position and the stern end of the watercraft port.

3. The floating watercraft port of claim 1, wherein the actuator system drives the bow stop from the home position to the extended position to push the watercraft along the transport track toward the stern end of the watercraft port during a launching procedure of the watercraft.

4. The floating watercraft port of claim 1, wherein the actuator system drives the bow stop from the extended position to the home position to pull the watercraft along the transport track toward the bow end of the watercraft port during a landing procedure of the watercraft, wherein the bow stop is coupled to the watercraft via a coupling element.

5. The floating watercraft port of claim 4, wherein the coupling element comprises a rope to secure the watercraft to the bow stop.

6. The floating watercraft port of claim 1, wherein the home position of the bow stop is adjustable over a portion of a longitudinal length of the upper surface.

7. The floating watercraft port of claim 6, wherein a bow stop bar is secured to the watercraft port to define the home position of the bow stop.

8. The floating watercraft port of claim 1, wherein the actuator system comprises a linear actuator.

9. The floating watercraft port of claim 1, wherein the actuator comprises:

drive shaft moveable between retracted and extended positions, a first end of the drive shaft coupled to the bow stop and an opposing second end coupled to an a portion of the watercraft port which is non-moveable relative to the bow stop; and an electric motor selectively activated to selectively drive the drive shaft between the extended and retracted positions to drive the bow stop between the extended and home positions.

10. The floating watercraft port of claim 9, wherein the actuator system includes a remote control to selectively activate the electric motor.

11. The floating watercraft port of claim 9, wherein the electric motor comprises a dc motor, and wherein the actuator system includes a battery to power the dc motor.

12. The floating watercraft port of claim 11, wherein the electric motor and battery as housed within the moveable bow stop.

13. The floating watercraft port of claim 1, wherein the transport track includes:

a port row of wheels and a starboard row of wheels extending symmetrically along opposite sides of a longitudinal centerline of the transport track from the stern end toward the bow end of the watercraft port; and a keel roller disposed symmetrically across the longitudinal centerline of the transport track and positioned between a bow end of the port and starboard rows of wheels and the bow stop.

14. The watercraft port of claim 13, wherein the transport track includes a pair of entrance wheels disposed between the port and starboard rows of wheels and the stern end of the watercraft port, the pair of entrance wheels disposed symmetrically on opposite sides of the longitudinal centerline of the transport track.

15. The watercraft port of claim 13, wherein a position of the keel roller is adjustable over a portion of the length of the transport track, and wherein vertical position of the keel roller relative to the upper surface is adjustable.

16. The watercraft port of claim 13, wherein axles of the wheels of the port and starboard rows of wheels are disposed at angles relative to horizontal, with the axles of the port and starboard rows of wheels each angled downward toward the longitudinal centerline of the transport track, wherein the angles become increasingly steeper from the stern end toward the bow end of the port and starboard rows of wheels.

17. The watercraft port of claim 16, wherein the wheels comprise wobble wheels which wobble back and forth over an angular wobble range relative to the axle such that an angular tilt range of the wobble wheels relative to horizontal becomes steeper from the stern end toward the bow end.

18. The watercraft port of claim 17, wherein the angular tilt range of wheels at the stern end of the port and starboard rows of wobble wheels wobble is between 15.5 and 20.5 degrees relative to horizontal, and the angular tilt range of wobble wheels at the bow end of the port and starboard rows of wobble wheels wobble is between 17.5 and 22.5 degrees relative to horizontal.

19. The watercraft port of claim 18, wherein the angular tilt range of wobble wheels in a middle portion of the port and starboard rows of wobble wheels, between the bow end and port end wobble wheels, is between 16.5 and 21.5 degrees relative to horizontal.

20. The floating watercraft port of claim 19, wherein the bow stop is selectively actuated to pull the watercraft along the transport track toward the bow end when landing the watercraft on the floating watercraft port, wherein the bow stop is selectively coupled to the watercraft when landing the watercraft on the floating watercraft port.

21. A drive-on floating watercraft port comprising:

a transport track extending across an upper surface of the floating watercraft port from a stern end toward a bow end, the transport track to carry and guide a hull of a watercraft across the upper surface;

an actuated bow stop disposed along a length of the transport track to define a bow end of the transport track, the bow stop selectively actuated back and forth along a portion of a length of the transport track to push a watercraft along the transport track toward the stern end when launching the watercraft from the floating watercraft port.

* * * * *